United States Patent [19]

Cavagnaro

[11] 4,194,829

[45] Mar. 25, 1980

[54] APPARATUS FOR PRODUCING DUPLEX COPIES

[75] Inventor: William A. Cavagnaro, Fairport, N.Y.

[73] Assignee: Eastman Kodak Company, Rochester, N.Y.

[21] Appl. No.: 942,566

[22] Filed: Sep. 15, 1978

[51] Int. Cl.[2] ..... G03G 15/00

[52] U.S. Cl. ..... 355/3 TR; 355/14 SH; 355/24

[58] Field of Search ..... 355/3 R, 24, 26, 3 TR, 355/3 SH, 14 SH

[56] References Cited

U.S. PATENT DOCUMENTS

| | | | |
|---|---|---|---|
| 3,672,765 | 6/1972 | Altmann | 355/24 |
| 3,687,539 | 8/1972 | Furuichi | 355/3 R X |
| 4,095,979 | 6/1978 | DiFrancesco et al. | 355/3 R X |

*Primary Examiner*—Fred L. Braun

*Attorney, Agent, or Firm*—William F. Noval

[57] ABSTRACT

Apparatus for producing duplex copies including an image transfer member movable at a first velocity and having first and second unfixed transferable images; and image transfer apparatus for transferring the first and second images to the first and second sides respectively of a copy sheet. A copy sheet turnover member is also provided adjacent to the image transfer member. The turnover member is movable in a first direction to separate a copy sheet to the first side of which the first image has been transferred. The turnover member is then movable in a second opposite direction to turnover the copy sheet while the first image is unfixed and to register the second side of the copy sheet with the second image on the image transfer member at the image transfer apparatus. A motor is provided for moving the copy sheet turnover member at a velocity equal to the first velocity both in the first direction during separation of the copy sheet from the image transfer member and in the second direction during registration of the copy sheet with the transfer member and at a velocity greater than the first velocity in either the first or second directions after the copy sheet is separated from but before it is brought back into registration with the transfer member.

11 Claims, 2 Drawing Figures

APPARATUS FOR PRODUCING DUPLEX COPIES

BACKGROUND OF THE INVENTION

1. Field of the Invention

This invention relates to apparatus for producing duplex copies. More particularly, this invention relates to apparatus for transferring unfixed transferable images to both sides of a copy sheet before fixing of either image to the copy sheet.

2. Description of the Prior Art

Several techniques are known in the prior art for forming duplex images on a final copy medium such as a web or sheet. One such technique requires the use of two photoconductors upon which first and second transferable images are formed respectively. The copy medium is generally passed between the photoconductors and the first and second images are transferred to opposite sides of the copy medium. Another technique similar to the above but involving the use of only one photoconductor, utilizes an intermediate image storage member such as a drum, to receive the first image formed on the photoconductor before transfer to a final copy medium. These techniques suffer the disadvantages of increased cost, machine complexity and size and decreased reliability necessitated by the use either of two photoconductive and optical systems or of additional components before transfer to a final copy medium. Additionally there is the probability of degradation in image quality when an intermediate storage member is used. Furthermore, in some instances the developed images are tackified by use of solvent vapors which are potentially flammable and which require the use of a consumable fluid which must be replaced periodically.

A further duplexing technique utilized in certain commercial electrophotographic machines includes a single photoconductor wherein first fixed images developed sequentially on the first sides of a plurality of copy sheets by an electrophotographic process are collected in an intermediate tray. The copy sheets are then sequentially transported back through the electrophotographic process to develop second fixed images on the second sides of the copy sheets, thus producing duplex copies. The latter "two-pass" process has several disadvantages. Because the first sides of all the copy sheets are developed before development of the second sides of the copy sheets, a duplex copy is not available for inspection until all of the first sides of the copy sheets and one set of the second sides thereof have been developed. In addition, the relatively long paper paths required in passing a copy sheet through the entire electrophotographic process twice greatly increases the possibility of paper jams and other potential copy handling complications. Moreover, environmental conditions of image formation and the physical parameters of the copy sheet may change resulting in images of varying quality on opposite sides of a single sheet and misregistration between images on opposite sides of a copy sheet may also result.

Still another duplex copying technique which may be considered especially relevant to the present invention involves fixing images to both sides of a copy sheet during a single pass through the disclosed electrophotographic processes. U.S. Pat. Nos. 3,506,347; 3,672,765; 3,869,202; and 3,947,270 disclose various embodiments of this technique. In the first patent just listed a first tackified image is formed on a transfer drum, the image is transferred to the first side of a copy sheet, and the sheet is inverted while the first tackified image dries and becomes fixed on the copy sheet. Thereafter, a second tackified copy image is formed on the transfer drum and the copy sheet is fed back into contact with the drum to transfer the second side of the copy sheet which is then transported to an output tray. In the latter three patents electrophotographic apparatus is disclosed for making copies wherein two images of an original are formed sequentially on a photoconductor, the images are developed and the first developed image is transferred to the first side of a copy sheet. The copy sheet is passed through a fuser to fuse or fix the first transferred image, is turned over and the opposite side of the copy sheet is brought into contact with the second developed image on the photoconductor. The second image is then transferred to the second side of the copy sheet, the copy sheet separated from the photoconductor and the second image fused by means of a second fuser. The disclosed techniques have several disadvantages. Since the first image is fixed before transfer of the second image, either two fusers must be used with attendant increase in cost, power and environmental heat or solvent fixing is used resulting in safety hazards and the inconvenience of handling consumable liquids.

Still another technique is disclosed in Research Disclosure, April, 1977, Pages 80–81, Item No. 15671, (published by Industrial Opportunities Ltd., Homewell, Havant Hampshire, United Kingdom) discloses a vacuum belt for inverting a copy sheet having a simplex unfixed image, the inverter being positioned between first and second transfer stations. The belt is driven in both clockwise and counterclockwise directions at film speed in order to transport the copy sheet in its turnover path at film speed. This technique may result in long interframe distances (i.e. the distance between successive image frames on the photoconductive member) due to space and time limitations to effect copy sheet turnover. Long interframe distances have disadvantages with respect to the efficiency and copy output for a given velocity of the photoconductive member.

SUMMARY OF THE INVENTION

The present invention alleviates the above and other disadvantages of prior duplex copiers. According to one feature of the invention a single copying process is provided resulting in decreased cost, size and complexity and increased reliability with no image degradation since no intermediate storage member is used. According to another feature of the invention unfixed images are formed on either one or both sides of a copy sheet before fixing of the images thus eliminating the need for a second fuser with attendant decreases in power usage, environmental heat and cost or for solvent fixing thus eliminating safety hazards and the inconvenience of replenishing liquids. Another feature of the invention reduces the length of the copy path from that required for "two-pass" duplexing thus reducing side to side copy quality variability and misregistration and the incidence of paper jams and increasing the production of a finished duplex copy. In addition interframe distances are kept to a minimum thus increasing the efficiency and copy output for a given velocity of the photoconductive member.

According to the present invention apparatus is provided for forming unfixed images on both sides of a copy sheet including an image transfer member having first and second transferable images and movable at a first velocity, image transfer means located in image transfer relationship with the image transfer member and copy sheet turnover means located adjacent to the image transfer member. The copy sheet turnover means is movable in a first direction to separate by vacuum attraction a copy sheet from the image transfer member after transfer of the first image to the first side of the copy sheet. After separation of the copy sheet from the image transfer member, the copy sheet turnover means is moved in a second direction to register the second side of the copy sheet with the second image on said image transfer member at said transfer means. Moving means are provided for moving the turnover means at a velocity equal to the first velocity in the first direction during separation of the copy sheet from the transfer member and in the second direction during registration of the copy sheet with the transfer member and at a velocity greater than the first velocity in either the first or second directions after the copy sheet is separated from the transfer member but before it is brought back into registration with said transfer member.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below reference is made to the accompanying drawings, in which.

DESCRIPTION OF THE PREFERRED EMBODIMENT

Figure 1:
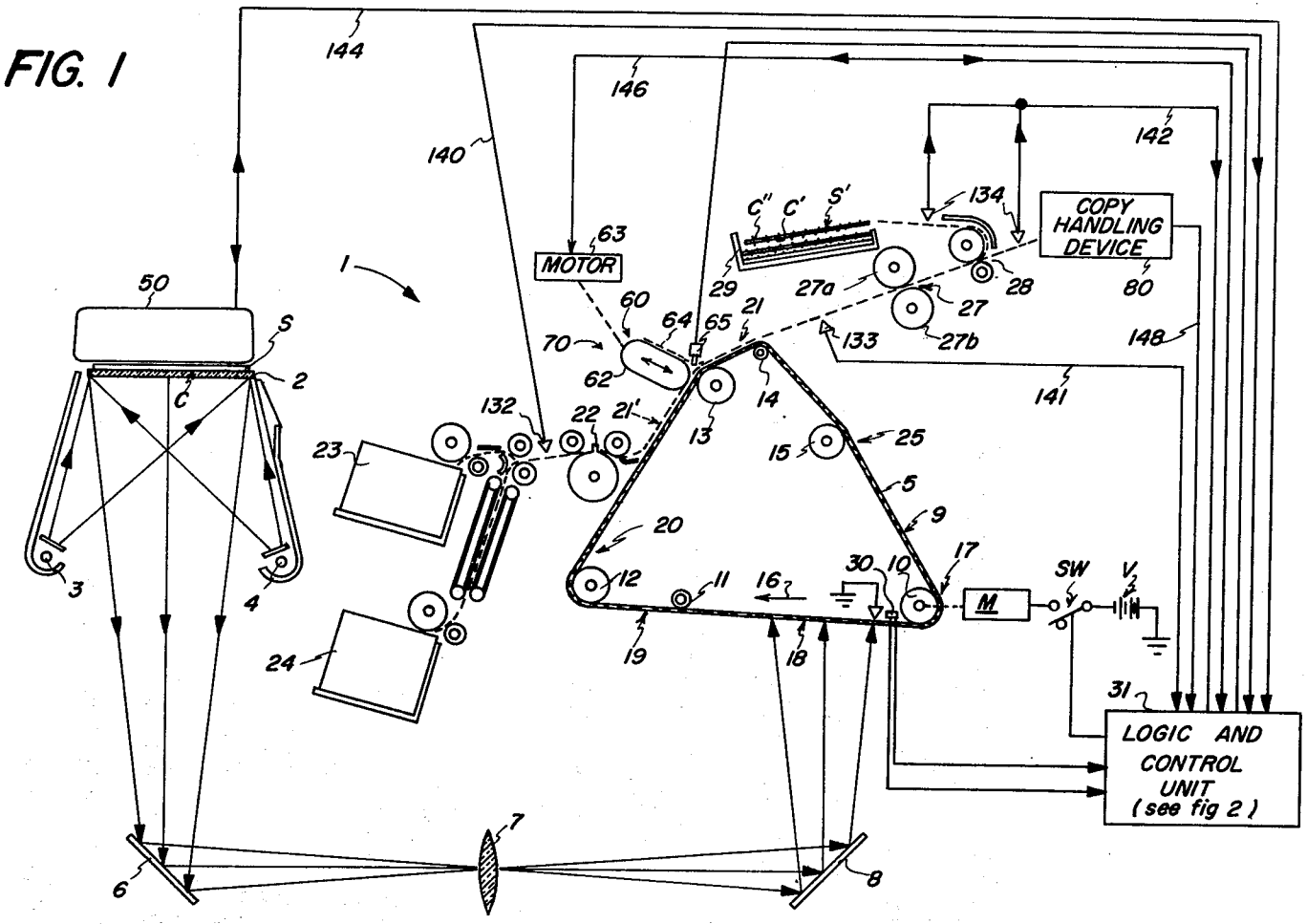
FIG. 1 is a schematic diagram of apparatus incorporating a preferred embodiment of the present invention.
Figure 2:
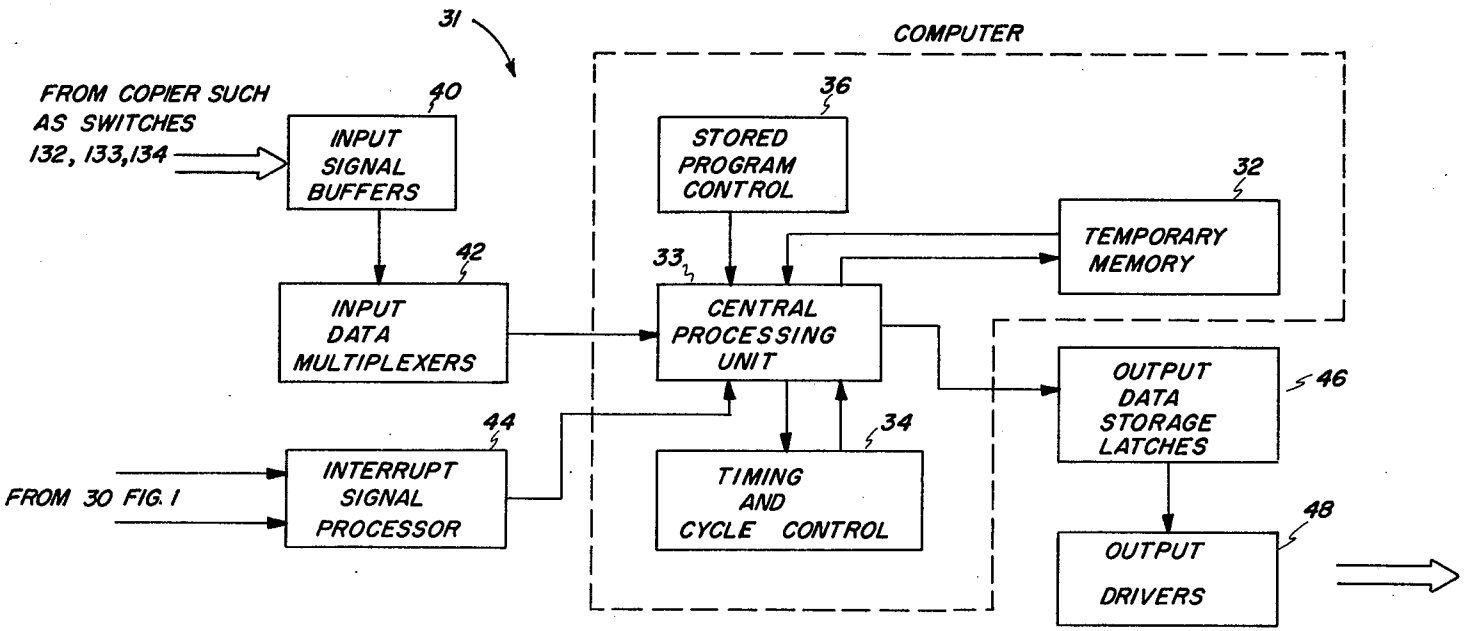
FIG. 2 is a block diagram of the control unit of FIG. 1.

Referring now to FIGS. 1 and 2 there is schematically illustrated electrophotographic apparatus 1 (referred to herein as a copier) including a duplex copy station according to the present invention. Only those features of the copier which are helpful for a full understanding of the preferred embodiment are described hereinafter. However, more complete description of the copier may be found in commonly assigned U.S. Pat. No. 3,914,047, patented: Oct. 21, 1975, in the names of Hunt et al.

A recirculating feeder 50 is positioned on top of exposure platen 2. The recirculating feeder may take the form of that disclosed in U.S. Pat. No. Re. 27,976 wherein a plurality of sheets of a document having images only on first sides of the sheets can be repeatedly fed in succession from an originating stack to the exposure platen 2 of copier 1. Feeder 50 places a selected side C of a sheet of an original document S with the selected side C facing an exposure platen 2 of the copier 1. The platen 2 is constructed of transparent glass. When energized, two xenon flash lamps 3 and 4 illuminate the selected side C of the original sheets S. By means of an object mirror 6, a lens 7, and an image mirror 8, a light image of the selected side C is reflected back from the exposure platen 2 and projected as an inverse or mirror image onto a discrete section of a photoconductive member 5. The photoconductive member 5 has a photoconductor 9 on a grounded conductive layer and a transparent support backing and is trained about six transport rollers 10, 11, 12, 13, 14 and 15 as an endless or continuous belt. Roller 10 is coupled to a drive motor M in a conventional manner. Motor M is connected to a source of potential V when a switch SW is closed by a logic and control unit (LCU) 31. When the switch SW is closed, the roller 10 is driven by the motor M and moves member 5 in a clockwise direction indicated by arrow 16. This movement causes successive sections of member 5 to sequentially pass a series of electrophotographic work stations.

For the purpose of the instant disclosure, the several work stations along the path of movement of member 5 may be described as follows:

- a charging station 17 at which photoconductor 9 of member 5 is sensitized by receiving a uniform electrostatic charge;
- an exposing station 18 at which the inverse image of the selected side C of the original sheet S is projected onto the photoconductor 9 of member 5; the image dissipates the electrostatic charge at the exposed areas of the photoconductor and forms a latent electrostatic image thereon which corresponds to the selected side C of the original sheet S;
- a developing station 19 at which developing powder, including electroscopic toner particles having an electrostatic charge opposite to that of the latent electrostatic image, is brushed over the photoconductor 9 and causes the toner particles to adhere to the latent electrostatic image to visibly form a toner image which is a mirror resemblance of the indicia on the selected side C of the original sheet S;
- a post development erase station indicated by arrow 20 at which the web is illuminated to reduce photoconductor fatigue, i.e., its inability to accept or hold an electrostatic charge;
- copy duplex station 70 (to be described in greater detail later) at which first and second unfixed toner images are electrostatically transferred from member 5 to opposite sides of a copy sheet S' before either image is fixed to sheet S'; and
- a cleaning station indicated by arrow 25 at which photoconductor 9 of member 5 is cleaned of any residual toner particles remaining thereon after the toner images have been transferred and is discharged of any residual electrostatic charger remaining thereon.

The details and operation of such a copier is shown in greater detail in U.S. Pat. No. 3,914,047, the contents of which is hereby incorporated by reference.

For the purposes of the present invention, first and second sequential unfixed toner images are formed on member 5 in accordance with the above described sequence of operations of electrophotographic apparatus 1.

Copy duplex station 70 includes a first image transfer station 21', a copy sheet turnover means 60 and a second image transfer station 21. Final supports or copy sheets S' are supported in supply bins 23 and 24. A copy sheet S' is transported from either of bins 23 or 24 to a first sheet registration device 22 where movement of sheet S' is checked to assure its arrival at first image transfer station 21' in registration with the arrival of the first unfixed toner image at station 21'. At transfer station 21' the first toner image carried on member 5 is transferred to the first side C' of sheets S' by electrostatic means.

Copy sheet turnover means 60 is shown as including an endless vacuum belt 62 a portion of which is in vacuum contact with the unimaged side of sheet S' as is separates from member 5 due to known detacking techniques and due to the bend in member 5 as it passes over roller 13. Vacuum belt 62 is mounted for movement in reversible directions by means of motor 63. A second sheet registrating device 65 is also provided for registering the copy sheet with the second toner image on member 5 at second transfer station 21.

According to the present invention, belt 62 is moved in a first direction (counterclockwise, as shown in FIG. 1) in order to separate sheet S' from member 5 after transfer of the first unfixed toner image thereto at first transfer station 21. Belt 62 is moved by motor 63 at a velocity $V_1$, equal to the velocity $V_m$ of member 5 so that the velocity of a copy sheet is maintained equal to the velocity of member 5 until it is completely separated therefrom. After separation, belt 62 is stopped and then reversed and moved by motor 63 in a second (clockwise) direction at a velocity $V_2$ greater than the velocity $V_m$ of member 5 so that the copy sheet is brough to a registration device 65 which momentarily stops sheet S'. Belt 62 is then moved at a velocity $V_3$ equal to the velocity $V_m$ of member 5 and registration device 65 is moved out of the path of sheet S' to synchronize the registration of the second side C'' of sheet S' with the second image on member 5. Belt 62 may also be moved at velocity $V_2$ in the first direction after movement thereof at velocity $V_1$. Thus the relationship of the velocity of a copy sheet S'0 with member 5 during turnover of the sheet are:

$$V_1 = V_m$$

and $$V_2 = X\ V_m \text{ and } V_3 = V_m$$

where $V_1$ is the velocity of the copy sheet (and belt) during separation.

$V_2$ is the velocity of the copy sheet (and belt) after separation but before registration.

$V_3$ is the registration velocity of the copy sheet (and belt) during registration.

$V_m$ is the velocity of the member 5.

and

X is a number greater than 1.

In general, according to the present invention the copy sheet is moved at a velocity greater than the velocity of member 5 either in the first or second directions after it is moved at velocity $V_1$ in the first direction but before it is moved at velocity $V_3$ in the second direction.

By increasing the velocity of the copy sheet after separation but before registration the interframe distances between successive images formed on photoconductive member 5 may be minimized, thus increasing the efficiency and copy output for a given velocity of the photoconductive member.

It should be noted that during inversion of copy sheet S', the first unfixed toner image transferred to the first side thereof remains unfixed and is not disturbed during turnover since vacuum belt 62 only comes into contact with the second side of sheet S'. Thus, no fuser is required to fix the first toner image to copy sheet S' before turnover of the copy sheet and transfer of the second toner image thereto.

After transfer of both unfixed toner images to copy sheet S', it is transported to fuser 27 which includes opposed fusing rollers **27*a* and 27*b*. Where the toner particles forming the images on sheet S' are heat fusible, rollers 27*a* and 27*b* are both heated to heat fuse both unfixed images to the opposite sides of sheet S' respectively. Where the toner particles are pressure fusible, rollers 27*a*, 27*b*** need not be heated and fixing to sheet S' is effected through pressure alone.

Duplex copy sheet S' may be transported to an output tray 29 or to a copy handling accessory 80 such as a finisher such as that disclosed in Research Disclosure Bulletin, Vol. 167, March, 1978, Item 1673 where the sheets may be stacked in a straight or offset manner or where groups of copy sheets corresponding to the sheets of the original may be stapled into booklets.

To coordinate operation of the various work stations 17, 18, 19, 60 and 25 with movement of the image areas on member 5 past these stations, the member 5 has a plurality of perforations, not shown, along one of its edges. At a fixed location along the path of movement, there is provided suitable means 30 for sensing perforations. This sensing generates input signals into a LCU 31 having a digital computer. The digital computer has a stored program responsive to the input signals for sequentially actuating then de-actuating the work stations as well as for controlling the operation of many other machine functions as disclosed in U.S. Pat. No. 3,914,047. Preferably, feeder 50 and copy handling accessory 80 are also controlled by LCU 31.

Logic and Control Unit 31

Programming of a number of commercially available minicomputers or microprocessors, such as an INTEL model 8080A microprocessor (which along with others can be used in accordance with the invention), is a conventional skill well understood in the art and for example is described in chapter 4 of "An Introduction To Microcomputers," Vol. II, published by Adam Osborne and Associates, Inc., Berkely, Cal. 1977. The following disclosure is written to enable a programmer having ordinary skill in the art to produce an appropriate program for the computer. The particular details of any such program would, of course, depend upon the architecture of the selected computer.

Turning now to FIG. 2, a block diagram of a typical logic and control unit (LCU) 31 is shown which interfaces with the copier 1 and the feeder 50. The LCU 31 consists of temporary data storage memory 32, central processing unit 33, timing and cycle control unit 34, and stored program control 36. Data input and output is performed sequentially under program control. Input data is applied either through input signal buffers 40 to a multiplexer 42 or to signal processor 44 from perforations detected on the web 5. The input signals are derived from various switches, sensors, and analog-to-digital converters. The output data and control signals are applied to storage latches 46 which provide inputs to suitable output drivers 48 which are directly coupled to leads which, in turn, are connected to the work stations. More specifically, the output signals from the LCU 31 are logic level digital signals which are buffered and amplified to provide drive signals to various clutches, brakes, solenoids, power switches, and numeric displays in the various copier work stations and feeder 50 of copier 1. The LCU 31 processing functions can be programmed by changing the instructions stored in the computer memory.

The time sequence of machine events and their relationship to each other is controlled, as noted above, by sensing perforations which correspond to the location of the image elements on the web 5 as these elements continue through the cycle of the copier's endless path. Thus, the detection of perforations by a sensor 30 is applied to the LCU 31 through the interrupt signal processor 44 (see FIG. 2) and is used to synchronize the various control mechanisms with the location of the image elements. These perforations generally are spaced equidistantly along the edge of the web member 16. For example, the web member 5 may be divided into six image areas by F perforations; and each image area may be subdivided into 51 sections by C perforations. These F and C perforations (not shown) are described in U.S. Pat. No. 3,914,047.

Returning now to the computer, the program is located in stored program control 36 which may be provided by a conventional Read Only Memory (ROM). The ROM contains the operational program in the form of instructions and fixed binary numbers corresponding to numeric constants. These programs are permanently stored in the ROM(s) and cannot be altered by the computer operation.

Typically, the ROM is programmed at the manufacturer's facility, and the instructions programmed provide the required control functions such as: sequential control, jam recovery, operator observable logic, machine timing, automatic document rearrangement and copy sheet duplexing. For a specific example, the total ROM capacity may be approximately 2,000 bytes with each byte being 8 bits in length. The program may require more than one ROM.

The temporary storage memory 32 may be conveniently provided by a conventional Read/Write Memory or Random Access Memory (RAM). Data, such as: copy requested count, copies processed count, and copies delivered count, at the exit as indicated by the switch 34, are stored in the RAM until successful completion of a copy cycle. The RAM is also used to store data being operated on by the computer and to store the results of computer calculations.

Sensors 132, 133 and 134 spaced along the copy sheet path provide inputs along leads 140, 141 and 142 respectively to LCU 31 to indicate copy sheet jam conditions which may necessitate shutdown of copier 1 in order to prevent damage to the various components thereof.

Leads 144 and 146 from feeder 50 and copy sheet inverter 60, respectively, provide inputs to and receive outputs from LCU 31 to synchronize the operation of these devices to produce duplex copy sheets by copier 1. Lead 148 from accessory 80 also provides inputs and receives outputs from LCU 31 to synchronize the operation thereof with the operation of copier 1.

The invention has been described in detail with particular reference to preferred embodiments thereof, but it will be understood that variations and modifications can be effected within the spirit and scope of the invention.

What is claimed is:

1. In apparatus for producing duplex copies, and including an image transfer member movable at a first velocity and having first and second unfixed transferable images and image transfer means for transferring the transferable images from the image transfer member to first and second sides respectively of a copy sheet, the improvement comprising:

copy sheet turnover means located adjacent to the image transfer member for turning over the copy sheet, said turnover means being movable in a first direction to separate from said transfer member a copy sheet to which said first transferable image has been transferred to a first side thereof and in a second direction after separation of the copy sheet from the image transfer member to turn over said copy sheet while said first image is unfixed and to register the second side of the copy sheet with the second transferable image on said image transfer member at the image transfer means; and means for moving said turnover means at a velocity equal to said first velocity both in said first direction during separation of said copy sheet from said transfer member and in said second direction during registration of said copy sheet with said transfer member and at a velocity greater than said first velocity in either said first or second directions after said copy sheet is separated from but before it is brought back into registration with said transfer member.

2. The apparatus of claim 1 including registering means operable in synchronism with said image transfer member for registering said second side of said copy sheet with said second image on said image transfer member.

3. The apparatus of claim 1 wherein said copy sheet turnover means includes a vacuum belt.

4. The apparatus of claim 1 wherein said copy sheet turnover means includes a vacuum drum.

5. The apparatus of claim 1 wherein said turnover means is moved by said moving means at said velocity greater than said first velocity in said second direction before being moved at said velocity equal to said first velocity.

6. In apparatus for producing duplex copies, and including a photoconductive member movable at a first velocity and having first and second unfixed toner images and image transfer means for transferring the toner images from the photoconductive member to first and second sides respectively of a copy sheet, the improvement comprising:

copy sheet turnover means located adjacent to the photoconductive member for turning over the copy sheet, said turnover means being movable in a first direction at a velocity equal to the first velocity of said photoconductive member to separate from said photoconductive member a copy sheet to which said first toner image has been transferred to a first side thereof and in a second direction after separation of the copy sheet from the photoconductive member at a velocity equal to the velocity of said photoconductive member to turn over said copy sheet while said first image is unfixed and to register the second side of the copy sheet with the second toner image on said photoconductive member at the image transfer means and at a velocity greater than the first velocity of said photoconductive member in either said first or said second directions after said copy sheet is separated from but before it is brought back into registration with said transfer member.

7. The apparatus of claim 6 including registering means operable in synchronism with said photoconductive member for registering said second side of said copy sheet with said second image on said photoconductive member.

8. The apparatus of claim 6 wherein said copy sheet turnover means includes a vacuum belt.

9. The apparatus of claim 6 wherein said copy sheet turnover means includes a vacuum drum.

10. The apparatus of claim 6 wherein said turnover means is moved at said velocity greater than said first velocity in said second direction before being moved at said velocity equal to said first velocity.

11. The apparatus of claim 6 including copy sheet supply means for supplying a copy sheet into registration with said first toner image on said photoconductive member at said image transfer means and fixing means for fixing said first and second toner images to said copy sheet.

* * * * *